US011965511B2

(12) United States Patent
Parmeter et al.

(10) Patent No.: US 11,965,511 B2
(45) Date of Patent: Apr. 23, 2024

(54) BELLOWS MOTOR EXPANSION CHAMBER FOR AN ELECTRIC SUBMERSIBLE PUMP

(71) Applicant: Halliburton Energy Services, Inc., Houston, TX (US)

(72) Inventors: Larry James Parmeter, Broken Arrow, OK (US); Jeffrey G. Frey, Broken Arrow, OK (US); Matthew Thomas King, Tulsa, OK (US); Brett D. Leamy, Claremore, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 897 days.

(21) Appl. No.: 16/467,604

(22) PCT Filed: Jan. 30, 2018

(86) PCT No.: PCT/US2018/015977

§ 371 (c)(1),
(2) Date: Jun. 7, 2019

(87) PCT Pub. No.: WO2018/144467

PCT Pub. Date: Aug. 9, 2018

(65) Prior Publication Data

US 2020/0072225 A1 Mar. 5, 2020

Related U.S. Application Data

(60) Provisional application No. 62/454,165, filed on Feb. 3, 2017.

(51) Int. Cl.
*F04D 13/10* (2006.01)
*E21B 43/12* (2006.01)
(Continued)

(52) U.S. Cl.
CPC ..... *F04D 13/10* (2013.01); *E21B 43/128* (2013.01); *F04D 13/06* (2013.01); *F04D 13/08* (2013.01);
(Continued)

(58) Field of Classification Search
CPC ..... F04D 13/08; F04D 13/10; F04D 13/086; F04D 13/06; F04D 13/062; F04D 29/086; E21B 43/128; E21B 43/2406
(Continued)

(56) References Cited

U.S. PATENT DOCUMENTS 4,421,999 A 12/1983 Beavers et al.
4,492,523 A * 1/1985 Knox ..... F04B 47/06 417/13
(Continued)

FOREIGN PATENT DOCUMENTS

WO WO-2015181541 A2 * 12/2015 ..... E21B 43/11855
WO 2016032521 A1 3/2016
WO 2016089399 A1 6/2016

OTHER PUBLICATIONS

Wadcutter—https://en.wikipedia.org/wiki/Wadcutter (Year: 2016).*
(Continued)

*Primary Examiner* — Christopher S Bobish
(74) *Attorney, Agent, or Firm* — DeLizio, Peacock, Lewin & Guerra, LLP

(57) ABSTRACT

A bellows motor expansion chamber for electric submersible pumps (ESP). An ESP assembly includes an electric submersible motor between a thrust chamber and a motor expansion chamber, the motor expansion chamber including a bellows coupled to a releasable bellows anti-movement system including a heat-activated release and alterable between an immobilizing position, wherein the releasable anti-movement system prevents concertinaed movement of
(Continued)

the bellows in the immobilizing position, and a released position, wherein the bellows is concertinaedly moveable in the released position, and wherein the releasable bellows anti-movement system is in the immobilizing position below a release temperature and in the released position above the release temperature. A filter section within a well fluid inlet of the bellows motor expansion chamber includes a least two concentric filters of varying porosity, and a housing surrounding the filters including angled ribs and flow holes.

20 Claims, 13 Drawing Sheets

(51) Int. Cl.

| | |
|---|---|
| ***E21B 43/24*** | (2006.01) |
| ***F04D 13/06*** | (2006.01) |
| ***F04D 13/08*** | (2006.01) |
| ***F04D 29/08*** | (2006.01) |

(52) U.S. Cl.
CPC ..... *F04D 13/086* (2013.01); *F04D 29/086* (2013.01); *E21B 43/2406* (2013.01)

(58) Field of Classification Search
USPC ... 417/423.3, 423.15, 423.11, 423.14, 424.1, 417/472, 414
See application file for complete search history.

(56) References Cited

U.S. PATENT DOCUMENTS

| | | | | |
|---|---|---|---|---|
| 4,583,923 | A | 4/1986 | James | |
| 5,711,879 | A * | 1/1998 | Carlson | B01D 29/111 210/497.01 |
| 7,806,670 | B2 | 10/2010 | Du | |
| 8,328,539 | B2 | 12/2012 | Watson et al. | |
| 2002/0192090 | A1* | 12/2002 | Du | F04D 13/10 417/423.11 |
| 2004/0149651 | A1* | 8/2004 | Ruppel | G01G 21/28 210/614 |
| 2007/0074872 | A1* | 4/2007 | Du | E21B 43/128 166/369 |
| 2011/0014071 | A1 | 1/2011 | Du et al. | |
| 2015/0337843 | A1 | 11/2015 | Tanner et al. | |

OTHER PUBLICATIONS

Concentric—https://www.merriam-webster.com/dictionary/concentric (Year: 2016).*
PCT Application Serial No. PCT/US2018/015977, International Search Report, mailed May 11, 2018, 3 pages.
PCT Application Serial No. PCT/US2018/015977, International Written Opinion, mailed May 11, 2018, 6 pages.
European Application Serial No. 18748823.4; EP Search Report; Nov. 13, 2020, 10 pages.

* cited by examiner

BELLOWS MOTOR EXPANSION CHAMBER FOR AN ELECTRIC SUBMERSIBLE PUMP

BACKGROUND

1. Field of the Invention

Embodiments of the invention described herein pertain to the field of submersible pump assemblies. More particularly, but not by way of limitation, one or more embodiments of the invention enable bellows motor expansion chamber for an electric submersible pump (ESP).

2. Description of the Related Art

Submersible pump assemblies are used to artificially lift fluid to the surface in deep wells such as oil or water wells when the pressure within the well is not enough to force fluid out of the well. A typical vertical electric submersible pump (ESP) assembly consists of, from bottom to top, an electrical motor, seal section, pump intake and centrifugal pump, which are all connected together with shafts. Centrifugal pumps accelerate a production fluid through stages of rotating impellers, which are keyed to the rotatable pump shaft. The electrical motor supplies torque to the shafts, which provides power to turn the centrifugal pump. The electrical motor is generally connected to a power source located at the surface of the well using a motor lead cable. The entire assembly is placed into the well inside a casing. The casing separates the submersible pump assembly from the well formation. Perforations in the casing allow well fluid to enter the casing.

In steam assisted gravity (SAGD) wells, ESPs are employed horizontally, rather than vertically. With the SAGD technique, a pair of horizontal wells are arranged with one well situated four to six meters above the other. In a plant nearby, water is vaporized into steam and the steam is injected into bitumen-rich oil sands near the upper of the two horizontal wells. The steam heats the heavy oil such that it flows by gravity into the bottom of the horizontal wells. The bottom horizontal well contains the horizontally arranged ESP assembly, which lifts the oil to the surface of the well.

Submersible pumps operate while submerged underground in the fluid to be pumped. The fluid enters the assembly at the pump intake and is lifted to the surface through production tubing. In order to function properly, the electrical motor must be protected from well fluid ingress, and thus a seal section is typically located between the pump intake and the electric motor to provide a fluid barrier between the well fluid and motor oil. Motor oil resides within the seal section, which is kept separated from the well fluid. In addition, the seal section supplies oil to the motor, provides pressure equalization to counteract expansion of motor oil in the well bore and carries the thrust of pump.

Pressure equalization in the ESP electrical motor is crucial for optimal pump performance. During installation and operation of an ESP assembly, the pump encounters fluctuating temperatures. The temperature at the surface of a downhole well may be about 70° F. (21.1° C.), whereas the temperature thousands of feet deep inside the well may be around 330° F. (165.6° C.). As the ESP assembly is deployed from the surface to its intended operating position inside the well, the ambient temperature increases hundreds of degrees. Once operating, an ESP assembly may further increase in temperature, reaching temperatures as high as 480° F. (249° C.) while the motor is turned on. In some high temperature applications, such as SAGD or lateral wells, the assembly may reach temperatures as high as 550° F. (288° C.). These wells also present unique problems since the ESP assembly operates in a horizontal orientation, rather than a traditional vertical orientation.

As the temperatures of the ESP motor increases and decreases, such as during deployment and through motor stops and starts, the motor oil inside the motor seal expands and contracts, creating pressure inside the motor of up to 5,000 psi (about 35,000 kPa). For this reason, metal bellows or elastomeric bags are used inside motor seal sections to equalize pressure. Well fluid surrounds the outside of the seal section and is able to move in and out of the seal section above the bellows or bag, while motor oil fills the inside of the seal section below the bellows or bag. As the temperature increases inside the ESP motor and the motor oil expands, the metal bellows or elastomeric bag expands and forces well fluid out of the seal to relieve the pressure. If the temperature decreases, the elastomeric bag or metal bellows contracts as the motor oil contracts, allowing well fluid to enter the seal section to fill the void.

Several problems arise with respect to pressure equalizers in high temperature applications such as SAGD or lateral wells. First, these wells commonly exceed 500° F. (260° C.) in temperature and are therefore too hot for elastomeric bags, which fatigue, melt or crack when exposed to the extreme heat and temperature fluctuation. This makes elastomeric bags impractical and leaves metal bellows as the better seal option for high temperature applications. Metals bellows also provide the benefit of providing a barrier to damaging hydrogen sulfide gas that tends to permeate elastomers and undesirably enter the motor if not blocked. However, positioning the ESP assembly with metal bellows inside a well has proved problematic. A rig lowers the ESP equipment string into the well in forty foot (12.2 m) sections of production tubing at about 4 feet/sec (1.22 m/s). As the ESP motor with its chamber of clean motor oil is deployed, the force of the well fluid against the large surface area of the bellows prematurely compresses the bellows and displaces most of the motor oil through check valves in the seal section, even though the temperature is increasing. To exacerbate the problem, the bellows oscillates up and down violently when the rig operator abruptly stops the well string. Severe oscillations further force motor oil out of the motor.

In addition, when filling the motor with motor oil, the bellows sometimes fully extends. Fully extending the bellows allows too much volume into the bellows chamber, preventing the bellows from expanding during operation. When the motor is turned off, the bellows contracts and forces more motor oil out than what is required to remain for proper bearing lubrication and cooling once operation commences.

Further, conventional bellows designs located in seal sections above the motor are necessarily complicated and expensive. Motor seals above the motor require mechanical seals, which dictates a two-piece bellows located inside the seal section. The mechanical seals are necessary to prevent well fluid from falling back down into the motor. This two-piece bellows design leads to an increased cost of thousands of U.S. dollars.

It would be an advantage for submersible motors to have improved handling of motor oil during deployment and when filling the motor, particularly in high temperature applications. It would further be an advantage for ESP motor seal bellows to be simplified to a single-bellows design.

Therefore, there is a need for an improved bellows motor expansion chamber for an electric submersible pump.

SUMMARY

Embodiments described herein generally relate to a bellows motor expansion chamber for an electric submersible pump (ESP). A bellows motor expansion chamber for an electric submersible pump is described.

An illustrative embodiment of an electric submersible pump (ESP) assembly includes an electric submersible motor between a thrust chamber and a motor expansion chamber, the motor expansion chamber including a bellows coupled to a releasable bellows anti-movement system, the releasable bellows anti-movement system including a heat-activated release and alterable between an immobilizing position, wherein the releasable anti-movement system prevents concertinaed movement of the bellows in the immobilizing position, and a released position, wherein the bellows is concertinaedly moveable in the released position, and wherein the releasable bellows anti-movement system is in the immobilizing position below a release temperature and in the released position above the release temperature. In some embodiments, the heat-activated release includes a pin configured to one of melt, shear or a combination thereof at the release temperature. In certain embodiments, the bellows includes a stem extending longitudinally from an end of the bellows, the heat-activated release includes a meltable pin, and the meltable pin extends through the stem. In some embodiments, the motor expansion chamber further includes a filter section, and the stem extends within a filter of the filter section at least when the bellows is extended. In certain embodiments, the meltable pin melts at between 180° C. and 190° C. In some embodiments, the motor expansion chamber further includes a filter section, the filter section including a first filter around a second filter. In certain embodiments, the filter section includes a plurality of protruding ribs extending around a housing of the filter section, and a series of flow holes extending through the housing and fluidly coupling the first filter with well fluid. In some embodiments, the protruding ribs include a bottom side angled upward towards the electric submersible motor. In certain embodiments, each flow hole of the series of flow holes extends through a protruding rib of the plurality of protruding ribs. In some embodiments, the filter section includes a bullet shaped end portion. In certain embodiments, the electric submersible motor is configured to be operated downhole, the releasable bellows anti-movement system is initially in the immobilizing position, and the heat-activated release is configured to alter the bellows anti-movement system into the released position after placement of the electric submersible motor downhole. In some embodiments, the motor expansion chamber further including a porous disk inserted into an aperture extending through a housing of the motor expansion chamber. In certain embodiments, the thrust chamber including a plurality of mechanical seals, a plurality of check valves, and at least one thrust bearing.

An illustrative embodiment of a method of equalizing pressure of an electric submersible pump (ESP) motor includes assembling an ESP system with the ESP motor between a thrust chamber and a bellows seal section, securing a bellows of the bellows seal section from concertinaed motion with an anti-movement pin, and configuring the anti-movement pin to release at a selected temperature. In some embodiments, the selected temperature is selected such that the anti-movement pin remains secure until the ESP system is set within a downhole well and releases one of prior to operation of the ESP system or at initial operation of the ESP system. In certain embodiments, the bellows, when released, equalizes pressure of the ESP motor by expanding as motor oil expands and contracting when the ESP motor is turned off. In some embodiments, the anti-movement pin releases by one of melting, shearing, or a combination thereof. In certain embodiments, the method further includes providing positive internal pressure in the thrust chamber using a plurality of check valves in the thrust chamber. In some embodiments, the method further includes assembling a filter at a well fluid inlet of a bellows of the bellows seal section to prevent debris from plugging convolutions of the bellows. In certain embodiments, the filter includes at least two concentric layers of steel wool separated by an apertured pipe. In some embodiments, the filter includes a ribbed housing with flow holes extending through ribs of the ribbed housing, and the method further including angling the ribs to produce low pressure area over the flow holes and prevent clogging of the flow holes. In certain embodiments, the method further includes interposing the filter between the bellows and a location of well fluid entry into the bellows seal section to slow the speed of entry of well fluid into the bellows seal section. In some embodiments, the anti-movement pin is a retaining pin comprised of a eutectic material, and the anti-movement pin is configured to release at the selected temperature by forming the retaining pin of the eutectic material that melts at the selected temperature. In certain embodiments, the method further includes lowering the ESP system into a steam-assisted gravity drainage (SAGD) well with the anti-movement pin secured in place during lowering.

An illustrative embodiment of an electric submersible pump (ESP) assembly includes a bellows motor expansion chamber including a metal bellows, and a well fluid inlet of the bellows motor expansion chamber comprising a filter section, the filter section including at least two concentric filters, each filter of the at least two concentric filters of varying porosity, and a housing surrounding the at least two concentric filters, the housing including angled ribs and flow holes serving as the well fluid inlet of the filter section, the flow holes extending through the housing and the at least two concentric filters. In some embodiments, the housing further includes a bullet shaped nose. In certain embodiments, the flow holes extend through the angled ribs of the housing. In some embodiments, the angled ribs include an upstream side angled upwards towards an electric submersible motor coupled above the bellows motor expansion chamber. In certain embodiments, the at least two concentric filters include stainless steel wool secured within an apertured tube between a pair of filtration disks.

An illustrative embodiment of an electric submersible pump (ESP) assembly includes an electric submersible motor adjacent to a motor expansion chamber, the motor expansion chamber including a bellows section and a filter section, the filter section including a central plunger tube, the bellows section including a bellows and a longitudinal stem extending from the bellows into the central plunger tube of the filter, the longitudinal stem having an aperture, a flanged adapter coupling the bellows section to the filter section, the flanged adapter including at least a portion of a stem guide extending through the flanged adapter, a pin extending through the aperture perpendicularly to the longitudinal stem, the pin secured within the stem guide, the pin releasing at a selected temperature, wherein below the selected temperature, the pin prevents concertinaed movement of the bellows, and above the selected temperature, the bellows is concertinaedly moveable. In some embodiments, the pin is made of a 60% lead and 40% tin solder and the selected temperature is 182° C.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1A:
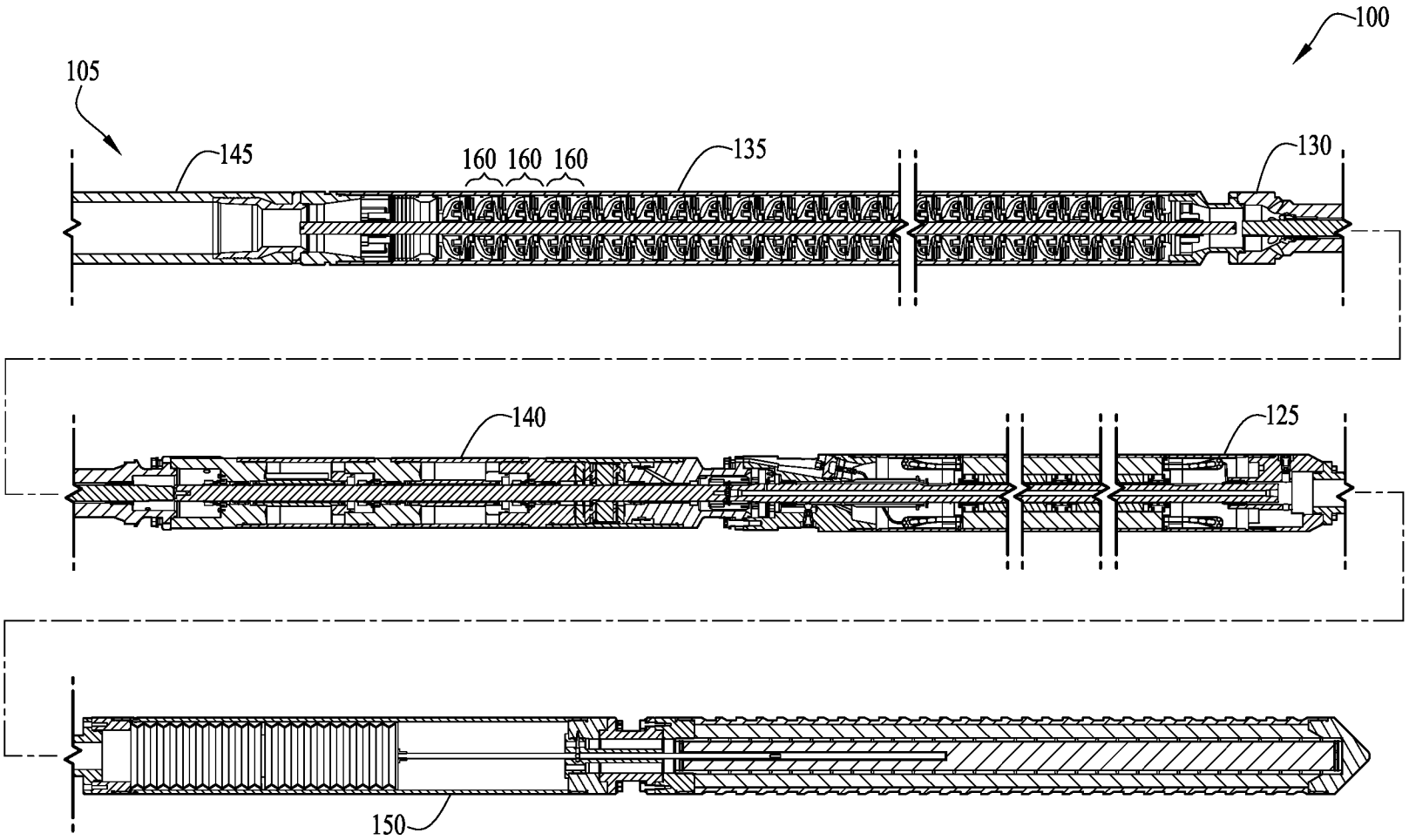
FIG. 1A is a cross sectional view of an electric submersible pump (ESP) assembly of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A bellows motor expansion chamber for an electric submersible pump (ESP) will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a "flow hole" includes one or more flow holes.

"Coupled" refers to either a direct connection or an indirect connection (e.g., at least one intervening connection) between one or more objects or components. The phrase "directly attached" means a direct connection between objects or components.

As used in this specification and the appended claims, "downstream" with respect to a downhole ESP assembly refers to the longitudinal direction through the well towards the wellhead. As used herein, the "top" of a component refers to the downstream-most side of the component. In horizontal embodiments, the top of a component may be on the left or right, depending on the direction of production fluid flow. Similarly, a first component above a second component means that the first component is downstream of the second component.

As used in this specification and the appended claims, "upstream" refers to the longitudinal direction through the well away from the wellhead. As used herein, the "bottom" of a component refers to the upstream-most side of the component. In horizontal embodiments, the bottom of a component may be on the left or right, depending on the direction of production fluid flow. Similarly, a first component below a second component means that the first component is upstream of the second component.

As used in this specification and the appended claims, "melt" or "melting" refers to the softening of a component due to increased heat to the point that the component shears, breaks or liquefies, whichever occurs first. Unless the context clearly dictates otherwise (such as if distinct shear and melt temperatures are stated), the "melting point" of a meltable component is the temperature at which the component, due to increased heat, shears, breaks or liquefies, whichever occurs first.

Illustrative embodiments of the invention described herein provide a bellows motor expansion chamber for electric submersible pumps. Illustrative embodiments may be particularly beneficial to provide pressure equalization of electric motors in steam assisted gravity drainage (SAGD) well systems making use of horizontal ESP assemblies, however the invention is not so limited. Illustrative embodiments may equally be employed in any bellows motor protector that may suffer from premature concertinaed movement during deployment or filling, and/or where a simplified single-bellows design is desired.

Illustrated embodiments may prevent premature loss of motor oil during deployment of an ESP assembly downhole in a well. Illustrative embodiments may prevent full extension of a bellows during filling of an electric motor with motor oil. Illustrative embodiments may eliminate the need for a seal section above an ESP motor, beneficially simplifying the pressure equalization chamber to a single-bellows design. Further, illustrative embodiments may eliminate the need for a shaft or mechanical seal inside the motor expansion chamber, further reducing cost.

Illustrative embodiments may provide a bellows style motor protector located below an ESP motor. The bellows style motor protector may include a bellows section, and a filter section below the bellows section and/or at the inlet to the bellows section. The bellows section may include a stem extending from the bellows bottom towards the filter section. A eutectic pin may interlock with the stem, holding the stem in place and preventing concertinaed movement of the bellows during motor fill-up and deployment of the ESP assembly. The composition of the pin material may be selected such that the pin melts at a selected temperature, which selected temperature may be slightly higher than the ambient temperature of a downhole well prior to motor operation. When the motor is turned on and begins to operate and/or when steam is injected into the well, the motor temperature may increase and the pin may melt, allowing the bellows to expand and contract uninhibited.

The filter section of the motor expansion chamber may prevent sand and other contaminants that may be present in the production fluid from reaching and damaging the bellows. The filter section may include a dual media filter having two concentric stainless steel wool filters separated by a perforated pipe. The housing of the filter section may include flow holes with flow diverters that angle upwards towards the motor and/or upwards in a downstream direction. The bottom of the motor expansion chamber may have a bullet-shaped nose. The flow diverters and bullet nose features may create a Bernoulli Effect producing a low pressure area over the flow holes. The low pressure area may reduce the instance of debris clogging the flow holes.

The motor expansion chamber of illustrative embodiments may include one or more porous disks inserted into apertures at or near the top of the motor expansion chamber. The porous disks may allow air to escape the bellows chamber when the bellows first makes contact with well fluid.

Figure 1B:
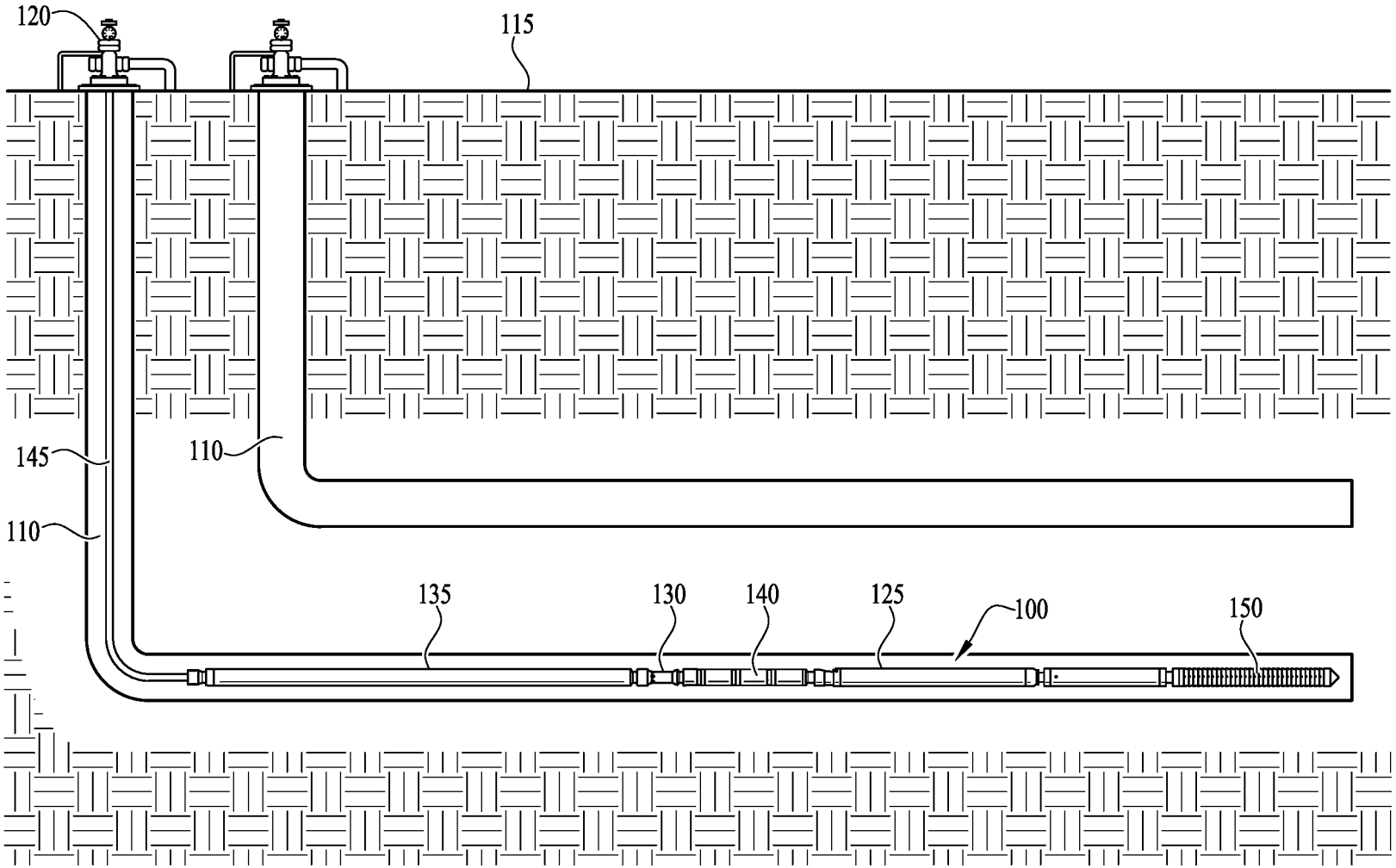
FIG. 1B is an elevation view of the ESP assembly of FIG. 1A deployed horizontally in a steam-assisted gravity drainage well.

FIG. 1A illustrates an exemplary ESP assembly of an illustrative embodiment. ESP assembly 100 may be downhole in a well, such as a well containing, oil, heavy oil, bitumen, natural gas and/or water. ESP assembly 100 may be arranged vertically or horizontally in the well and/or may extend through a radius. For example, FIG. 1B illustrates an exemplary embodiment where ESP assembly 100 is arranged horizontally in lower well 110 of two horizontal wells 110, situated one above the other. In horizontal embodiments, the pump end 105 (shown in FIG. 1A) of ESP assembly 100 may face downstream and/or through well 110 in the direction towards wellhead 120. In the embodiment shown in FIG. 1B, during deployment of ESP assembly 100 into well 110, ESP assembly 100 may first be lowered vertically and then turn to a horizontal orientation as the well curves in order to operate in a horizontal orientation.

As shown in FIG. 1A, ESP assembly 100 may include electric motor 125 that operators to turn the shafts extending longitudinally through ESP assembly 100 downstream of ESP motor 125, such as the shaft of ESP pump 135. As illustrated in FIG. 1A, no shaft extends through bellows motor expansion chamber 150 below (upstream of) motor 125. Electric submersible motor 125 may be an induction motor such as a three-phase, two-pole squirrel cage induction motor. Intake 130 may serve as the intake for ESP pump 135. ESP pump 135 may be a multi-stage centrifugal pump including impeller and diffuser stages 160 stacked one above the other around the shaft of ESP pump 135. The impellers rotate with the shaft of ESP pump 135 inside non-rotating diffusers to create pressure lift. Production tubing 145 may carry fluid lifted by ESP pump 135 to surface 115. Conventionally, a seal section would be located between ESP pump 135 and motor 125. The seal section would serve to keep motor oil separate from well fluid and provide pressure equalization to for motor 125. However, illustrative embodiments omit the seal section between ESP motor 125 and intake 130, and instead provide thrust chamber 140 between ESP motor 125 and intake 130.

Figure 2:
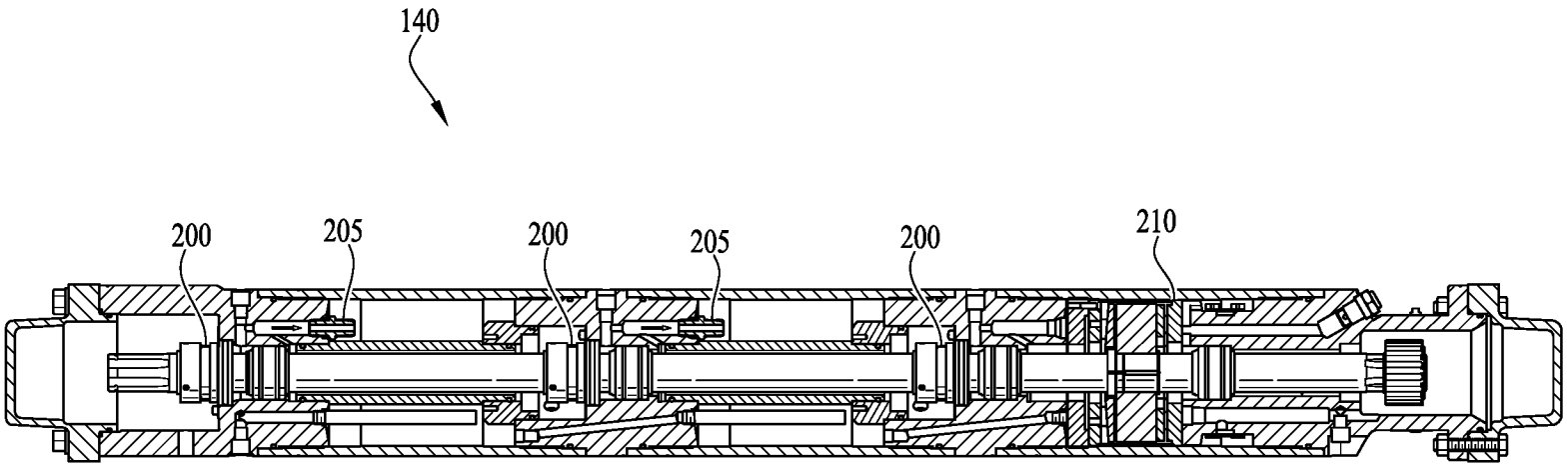
FIG. 2 is a cross sectional view of a thrust chamber of an illustrative embodiment.

FIG. 2 illustrates thrust chamber 140 of an illustrative embodiment. As shown in FIG. 2, thrust chamber 140 may include a plurality of mechanical seals 200 and check valves 205. Mechanical seals 200 and check valves 205 may prevent well fluid from falling and/or flowing upstream into motor 125. Check vales 205 may crack open at about 26 psi (179.2 kPa), providing positive internal pressure that may prevent well fluid ingress into motor 125. Thrust bearing 210 may assist in handling the thrust of ESP pump 135. Mechanical seals 200 may protect thrust bearing 210 from well fluid. Multiple mechanical seals 200 may be employed for redundancy.

Figure 3A:
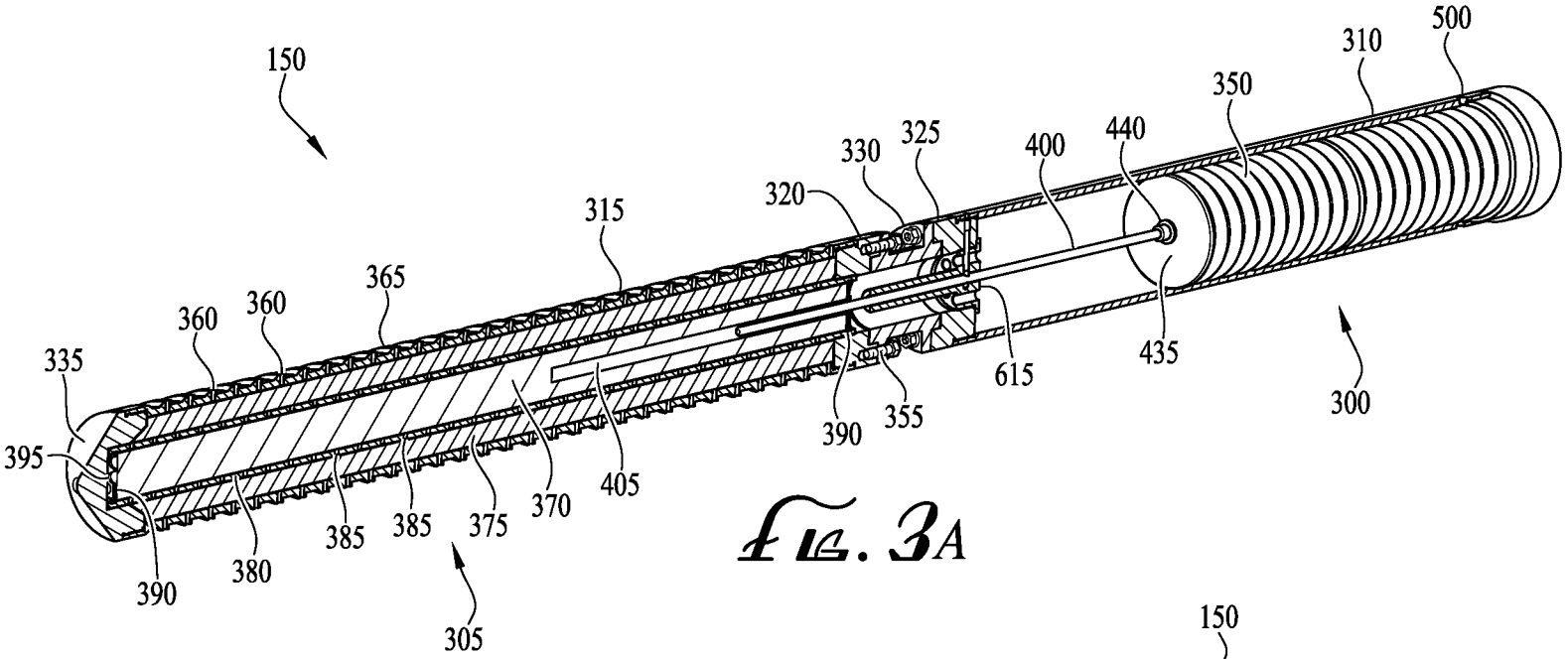
FIGS. 3A-3B are cross sectional views of an inside of a motor expansion chamber of an illustrative embodiment.

Returning to FIG. 1A, motor expansion chamber 150 may be attached below motor 125. Motor expansion chamber 150 may serve to equalize pressure within motor 125, a function not provided by thrust chamber 140. Because motor expansion chamber 150 is coupled below motor 125, rather than above motor 125, it is not necessary for a shaft to extend through motor expansion chamber 150. Mechanical seals are not necessary inside chamber 150 since the arrangement presents no risk of well fluid "falling" from chamber 150 into motor 125. Referring to FIG. 3A, chamber 150 may include bellows section 300 and filter section 305. Bellows section housing 310 may be bolted by flanged connector 420 (shown in FIG. 9) or otherwise attached to the bottom of motor 125. Well fluid may surround bellows section housing 310 and motor oil may fill the inside of bellows section housing 310 above bellows 350. The outer surface of bellows section housing 310 may be coated with an abrasion resistant silicone epoxy anti-friction coating, such as the coating known as Slickcoat (a registered trademark of Foundation Technologies, Inc.). The coating may prevent tar or minerals from adhering to the bore.

Figure 3B:
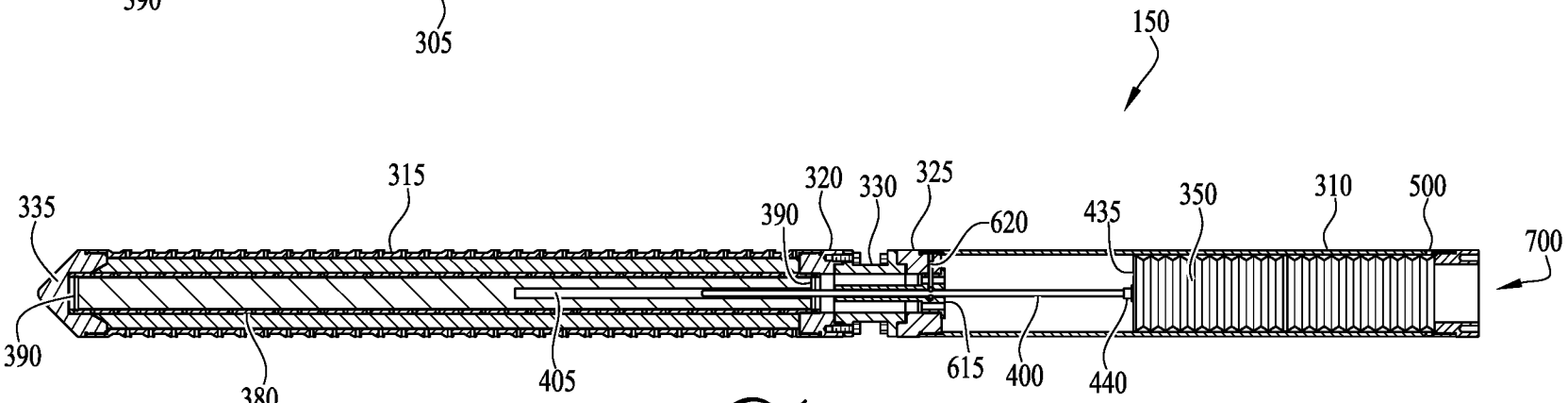
Figure 4:
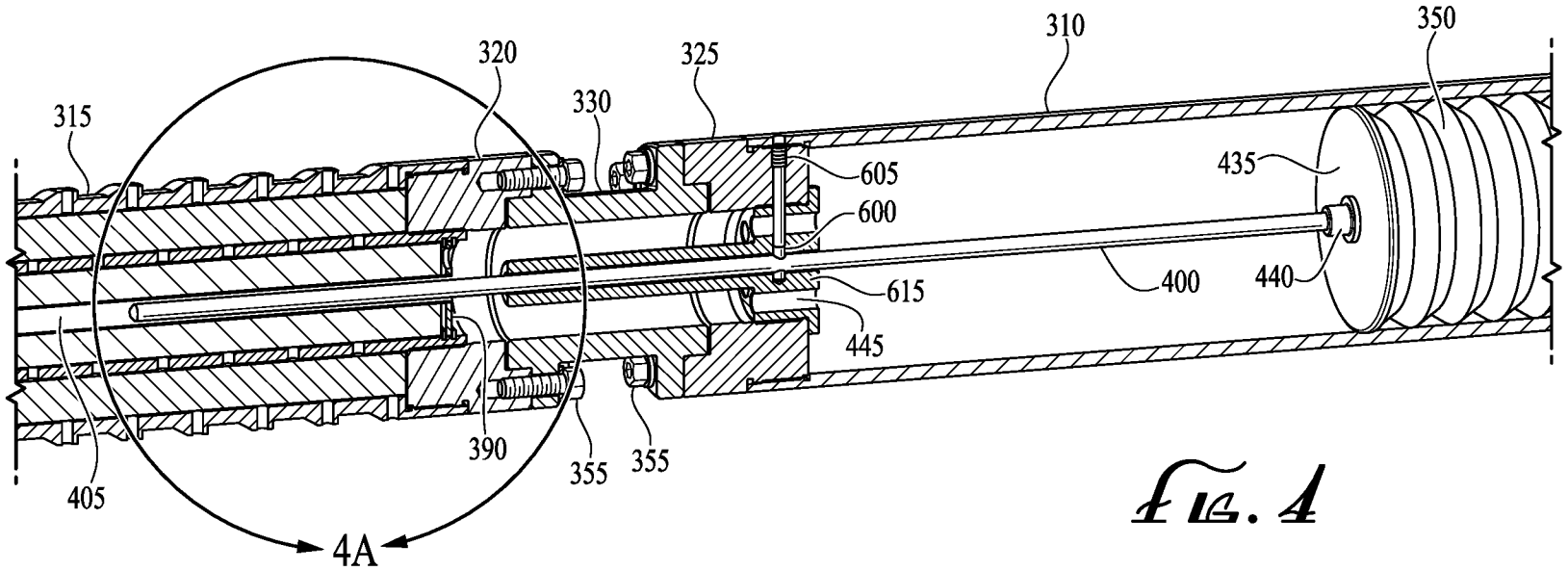
FIG. 4 is a cross sectional view of filter section and bellows section adapter of a motor expansion chamber of an illustrative embodiment.

FIGS. 3A and 3B illustrate a motor expansion chamber 150 of an illustrative embodiment including a bellows section 300 and a filter section 305. Bellows section 300 may be located at the top of chamber 150 and/or adjacent to motor 125. Filter section 305 may be attached to bellows section 300 below bellows section 300 and/or filter section 305 may serve as the inlet of well fluid into bellows section 300. Bellows section 300 may be enclosed by bellows housing 310 and filter section 305 may be surrounded by filter housing 315. As shown in FIG. 4, the top of filter housing 315 may include filter adapter 320 and the bottom of bellows housing 310 may include bellows adapter 325. Flanged adapter conduit 330 may interlock with, attach and/or couple filter adapter 320 to bellows adapter 325 such as by bolt 355, threading and/or screw. Adapter conduit 330, bellows adapter 325 and/or filter adapter 320 may be flanged and/or tubular such that the adapters fluidly connect the interiors of filter section 305 and bellows section 300.

Figure 4A:
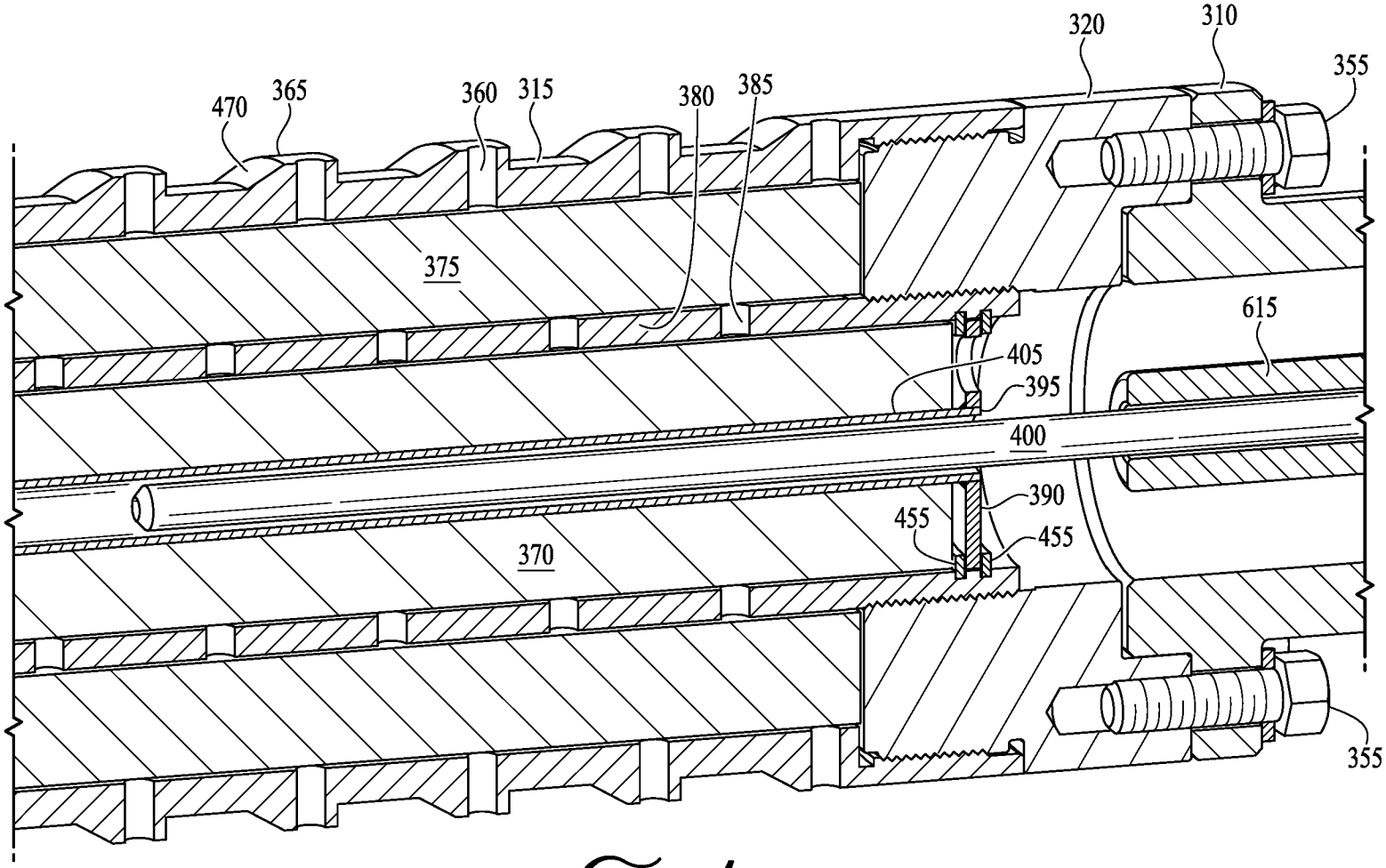
FIG. 4A is an enlarged view of the filter section of FIG. 4.
Figure 5:
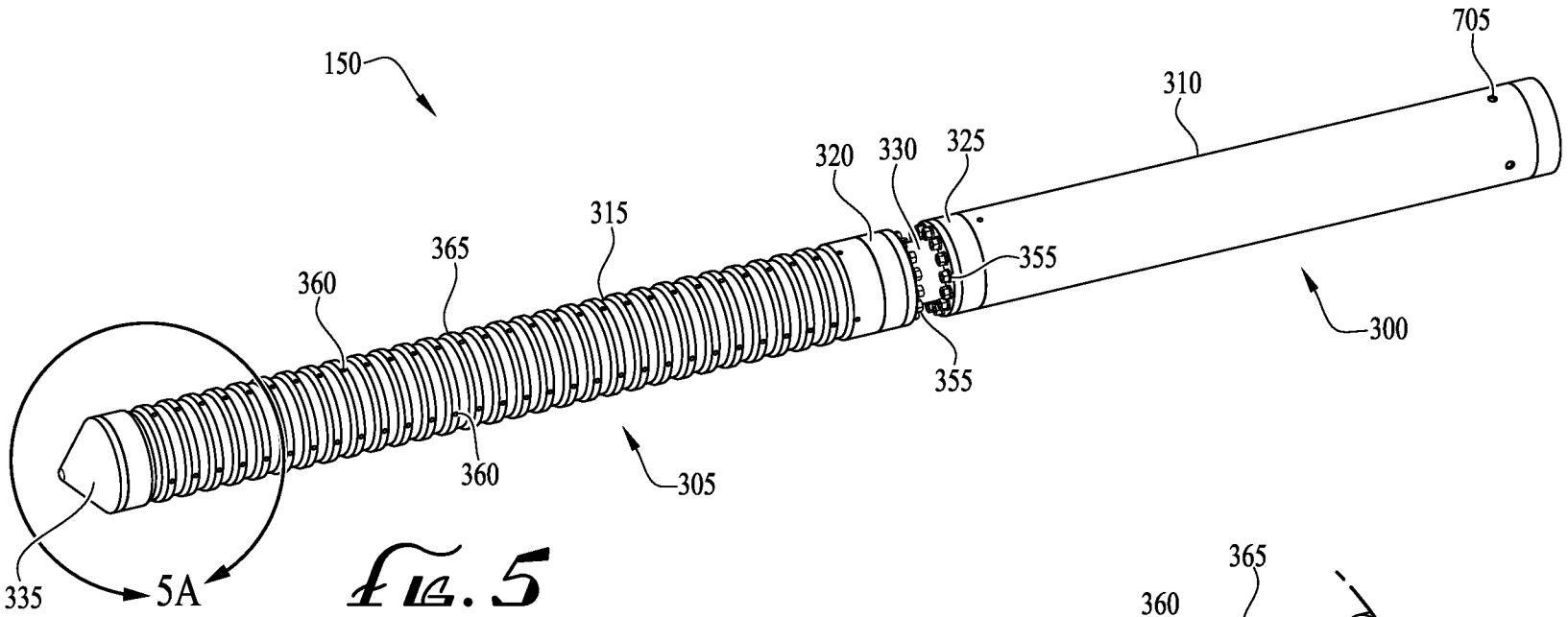
FIG. 5 is a perspective view of a housing of a motor expansion chamber of an illustrative embodiment.
Figure 5A:
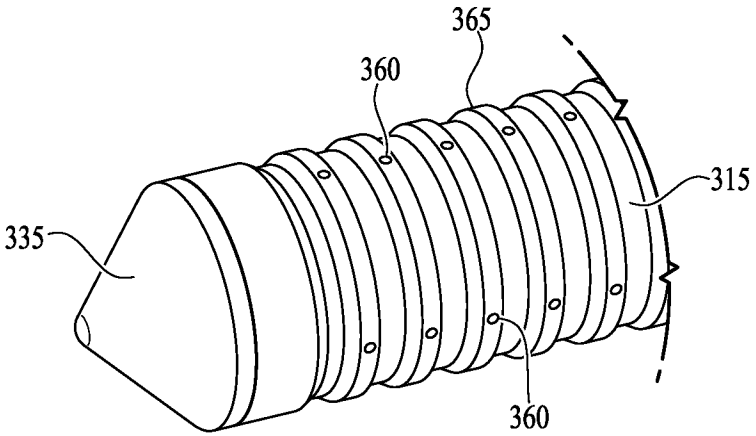
FIG. 5A is an enlarged perspective view of the housing of the motor expansion chamber of FIG. 5 of an illustrative embodiment.

FIG. 5 illustrates a perspective view of bellows housing 310 attached to filter housing 315, connected by adapter conduit 330. As illustrated, a series of bolts 355 may secure adapter conduit 330 to each of bellows adapter 325 and filter adapter 320 on each end of adapter conduit 330. As shown in FIG. 5A, filter housing 315 may include bullet-shaped nose 335 and/or a bullet-shaped end piece screwed and/or attached on the bottom end of filter section 305. The tapered shape of nose 335 may direct fluid outwardly around nose 335 as well fluid flows downstream. Filter housing 315 may include a plurality of cross-drilled flow holes 360 spaced circumferentially around and/or axially along filter housing 315. Filter housing 315 may include beveled ribs 365. Ribs 365 may be a series of angled projections aligned with flow holes 360. Flow holes 360 may extend through the highest (outermost) portion of ribs 365. The bottom side 470 (shown in FIG. 4A) of ribs 365 may be angled upwards towards motor 125 and/or angled upwards in a downstream direction towards motor 125. Nose 335, ribs 365 and/or flow holes 360 may provide for high velocity of well fluid passing by flow holes 360, creating a low pressure area over flow holes 360. The low pressure area over flow holes 360 may prevent debris from clogging flow holes 360. A series of ribs 365 may extend the length of filter housing 315, spaced at even intervals. Flow holes 360 may extend completely through filter housing 315 and serve as the entry for well fluid to enter filter section 305. In some embodiments, flow holes 360 may be round, oval-shaped, oblong, slots or a similar shape.

As bellows 350 expands and contracts, well fluid may enter and exit flow holes 360. Returning to FIGS. 3A-3B, filter section 305 may include one or more filters to prevent debris such as sand, dirt, rock and other contaminants from damaging bellows 350 as well fluid enters and exits motor expansion chamber 150. Should debris accumulate on bellows 350 and/or convolutions of bellows 350, bellows 350 may be undesirably prevented from contracting when pressure equalization is needed. Referring to FIG. 3A, filter section 305 may include two or more concentric filters comprising inner filter element 370 and outer filter element 375. Inner filter element 370 and outer filter element 375 may be separated by a separation pipe 380. Separation pipe 380 may include apertures 385 to allow well fluid to travel between and/or through filter elements 370, 375. Outer filter element 375 may be courser than inner filter element 375. Outer filter element 375 may filter larger solid contaminants whereas inner filter element 370 may remove finer (smaller) contaminants from well fluid travelling through filter section 305. Inner filter element 370 and outer filter element 375 may for example be stainless steel wool. Inner filter element 370 may extend inside separation pipe 380, whereas outer filter element 375 may extend between filter housing 315 and separation pipe 380. In addition to keeping debris from entering bellows section 300, filter section 305 may slow down and/or control the velocity that well fluid may enter bellows section 300.

One or more filter discs 390 may be included at and/or across the top and/or bottom of separation tube 380. At the bottom of separation tube 380, filter disc 390 may extend across the bottom end of separation tube 380 and/or proximate the bottom of separation tube 380 to secure filter element 370 inside separation tube 380. Filter disc 390 may include openings 395 and serve to hold inner filter element 370 in place, yet still allow fluid to pass by filter disc 390. Turning to FIG. 4A, at the top end of separation tube 380, filter disc 390 may similarly extend across the top of separation tube 380 to secure inner filter element 370 between filter discs 390 and/or inside separation tube 380 while still allowing fluid to pass by filter disc 390. Snap rings 455 may be placed above and below each filter disc 390 to hold filter disc 390 securely in place. Plunger tube 405 may be welded to central opening 395 in filter disc 390 at the top of filter section 305, and may keep stem 400 square to and/or aligned with the bore as stem 400 passes into plunger tube 405 and/or inner filter element 370. Stem 400 may extend through central opening 395 in filter disc 390 and/or plunger tube 405 as stem 400 extends into filter section 305.

Figure 9:
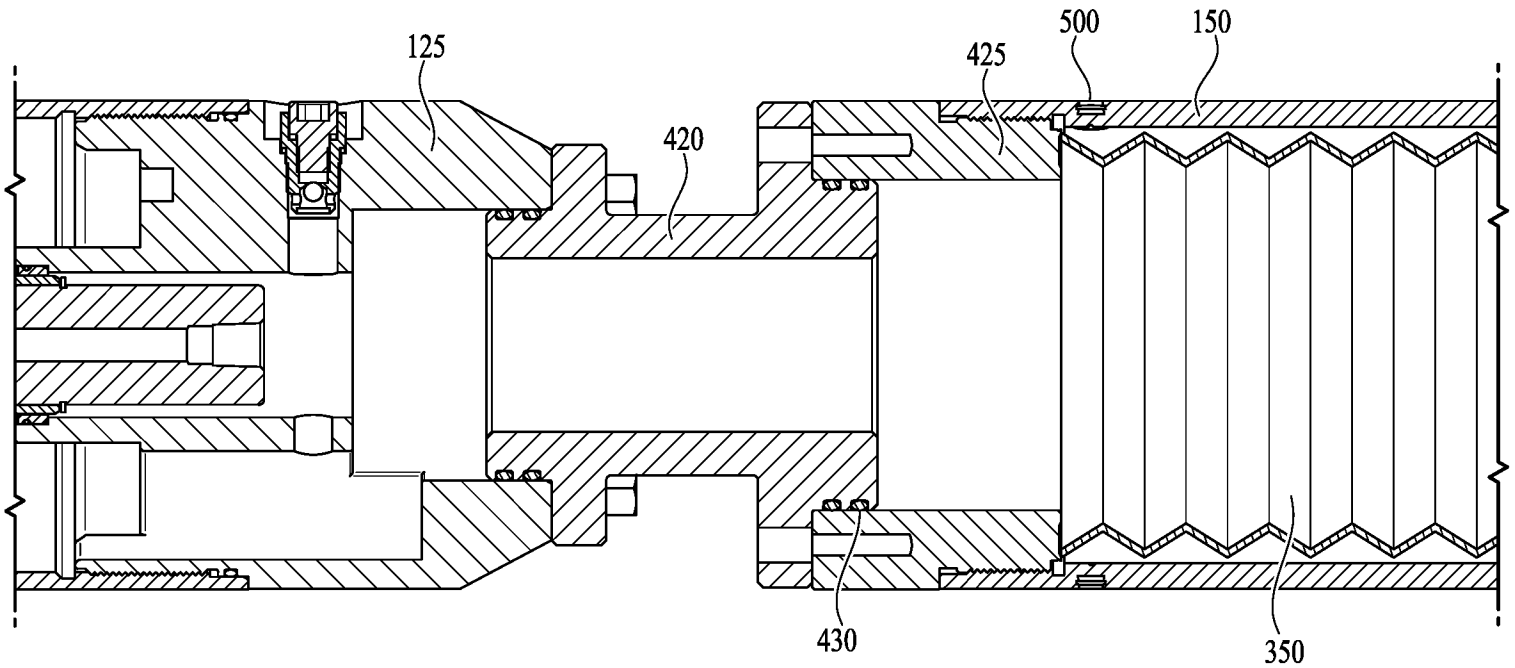
FIG. 9 is a cross sectional view of a connection between a motor and a motor expansion chamber of an illustrative embodiment.

Bellows section 300 may be above filter section 305 and/or adjacent to motor 125. Bellows section 300 may include one or more bellows 350. In some embodiments, only a single bellows 350 may be necessary, reducing the cost of motor expansion chamber 150. Bellows 350 may be a metal bellows made from an edge welded, austenitic nickel-chromium-based superalloy commonly known as Inconel (a registered trademark of Huntington Alloys Corporation), stainless steel, or another similar material resistant to $H_2S$ permeation and high temperatures, such as temperatures up to 288° C. Turning to FIG. 9, head 425 of bellows 350 may be welded to flanged connector 420 that bolts to motor 125. Elastomeric ring 430 may create a seal to prevent well fluid and motor oil from mixing. Bellows 350 may expand and contract as motor oil expands and contracts, in a concertinaed and/or accordion-like movement that may equalize pressure within motor 125. Head 425 of bellows 350 may remain secured in place as tail 435 (shown in FIG. 3A) moves up and down. The concertinaed motion may allow expansion of motor oil during operation and/or during exposure to heat, and contraction when the motor is shut down and/or relatively cooler.

Figure 6:
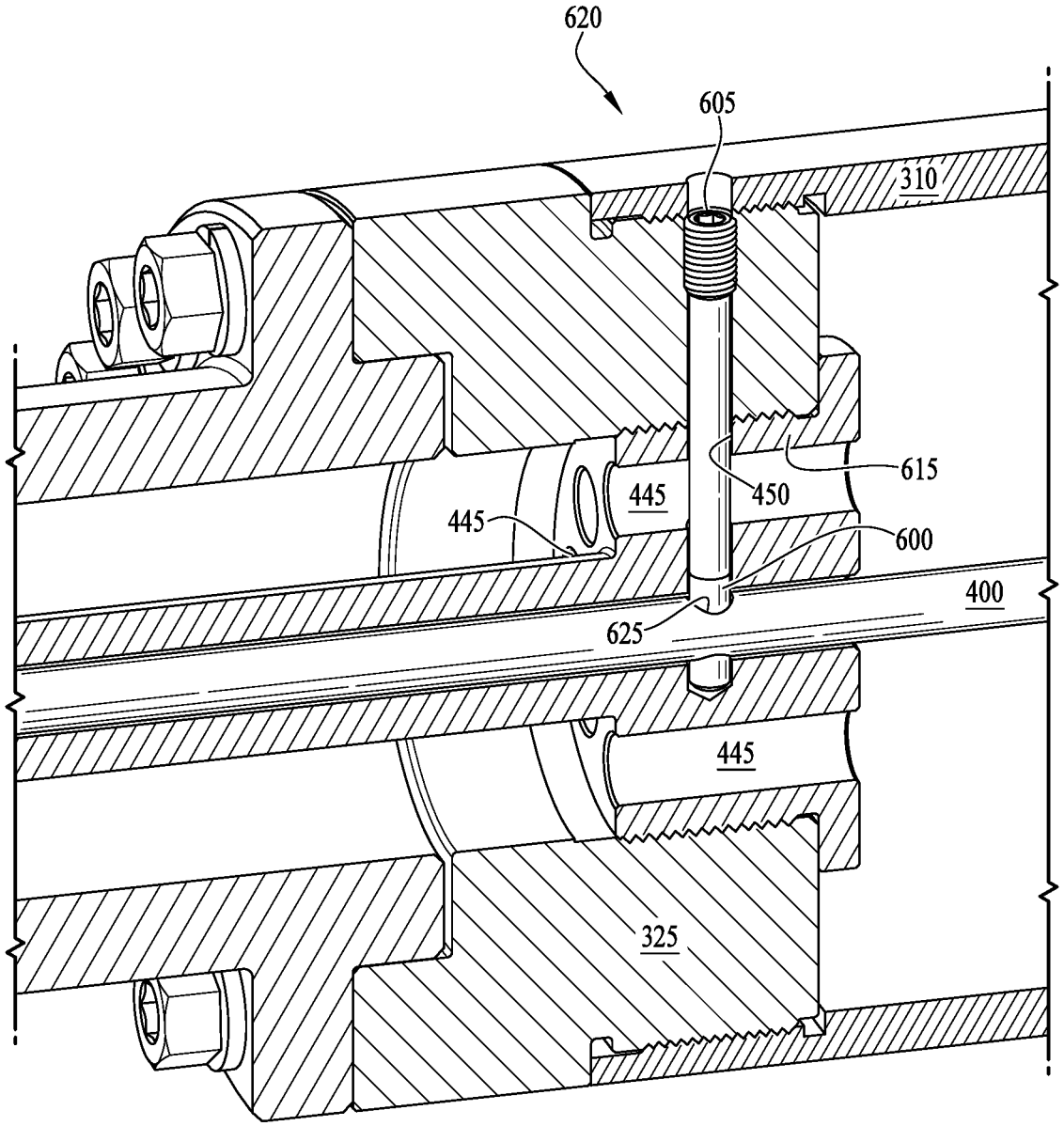
FIG. 6 is a cross sectional view of a bellows anti-movement system of an illustrative embodiment.

To deploy ESP assembly for operation within well 110, ESP assembly 100 may be lowered into well 110 at about 4 ft/sec (1.22 m/s) by a rig. Conventionally, the force of well fluid pressing against the surface area of bellows 350 as assembly 100 is lowered may compress bellows 350 and undesirably displace most of the motor oil through check valves that would conventionally be located in a seal section above the motor. To prevent the undesirable displacement of motor oil, a releasable bellows anti-movement system may be employed. FIG. 6 illustrates a releasable bellows anti-movement system of an illustrative embodiment. Anti-movement system 620, when in place, may prevent concertinaed movement of bellows 350.

Referring to FIG. 4 and FIG. 6, bellows 350 may include stem 400 extending longitudinally from tail 435 (bottom and/or upstream side) of bellows 350. Stem 400 may for example be a rod. Flanged sleeve 440 may secure stem 400 to bellows tail 435. Flanged sleeve 440 may include a flange that is welded to tail 435 of bellows 350, and stem (rod) 400 may be threaded into the sleeve portion of flanged sleeve 440. Stem 400 may extend through bellows adapter 325, adapter conduit 330, filter adapter 320 and into plunger pipe 405 inside inner filter element 370. Guide 615 may be screwed and/or threaded into bellows adapter 325 and may have one or more hollow guide openings 445, including one guide opening 445 through which stem 400 may extend. Guide 615 may serve to keep stem 400 centered within adapters 325, 330 as stem 400 extends through chamber 150 and/or may serve to align aperture 625 in stem 400 with pin 600. Guide 615 may include a channel 450 normal to hollow opening 445 through which pin 600 and/or pin retainer 605 may extend, for example channel 450 may extend radially from bellows section housing 310 toward stem 400. Stem 400 may include stem aperture 625 extending completely through or at least partially through stem 400. Stem aperture 625 may be positioned to align with the portion of stem 400 passing through bellows adapter 325 and/or aligned with pin 600.

As shown in FIG. 6, pin 600 may extend through stem aperture 625, both above and below stem aperture 625 and/or stem 400. In some embodiments, aperture 625 may only extend partially through stem 400 such that pin 600 interlocks with stem 400, rather than passing completely through stem 400. Pin 600 may be a eutectic pin made of a solder. The composition of the solder comprising pin 600 may be selected based on the melting point of the solder. For example, in SAGD embodiments, solder may be a 60/40 lead and tin composition having a melting point of 370° F. (188° C.). In this example, pin 600 may shear at 357° F. (180° C.) and melt at 370° F. (188° C.). As will be appreciated by those of skill in the art, different compositions of solder for pin 600 may be selected to vary the shear point and/or melting point of pin 600 based on anticipated temperatures experienced within well 110 and/or the operating conditions of ESP assembly 100. The melting point of pin 600 should be selected such that pin 600 remains secured in place at least until ESP assembly 100 is set in place for operation. For example, pin 600 should remain secured in place as ESP assembly 100 is being lowered into position within well 110. Once ESP assembly 100 is set in place, as steam is injected in a parallel well, the temperature of well 110 including ESP assembly 100 may rise, causing pin 600 to shear and/or melt. When in place, pin 600 may prevent concertinaed movement of bellows 350. Shearing and/or melting of pin 600 may allow bellows 350 to expand and contract to equalize pressure within chamber 150. Pin 600 may be held in place by retainer 605. Retainer 605 may be a threaded plug that may be made of steel. Retainer 605 may stay fixed in place when pin 600 melts.

Figure 7:
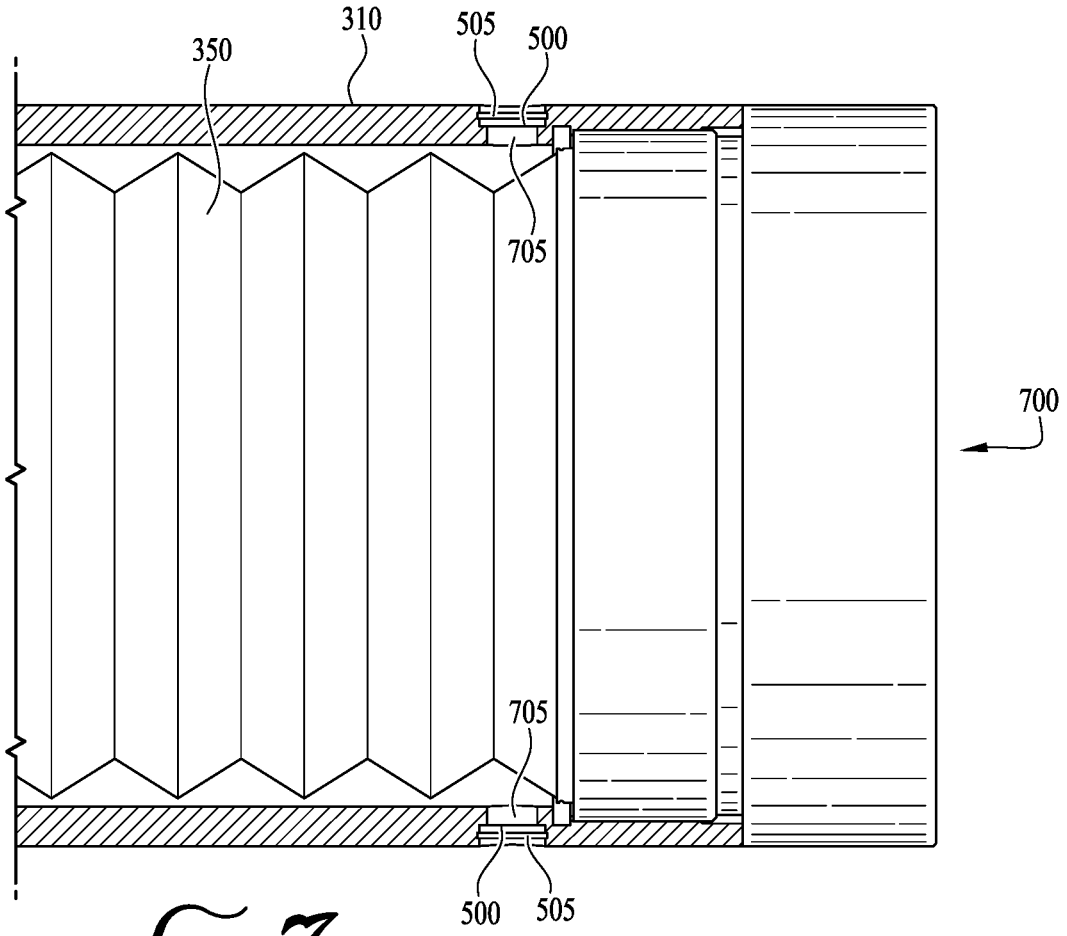
FIG. 7 is a perspective view of a porous disk of an illustrative embodiment.
Figure 7A:
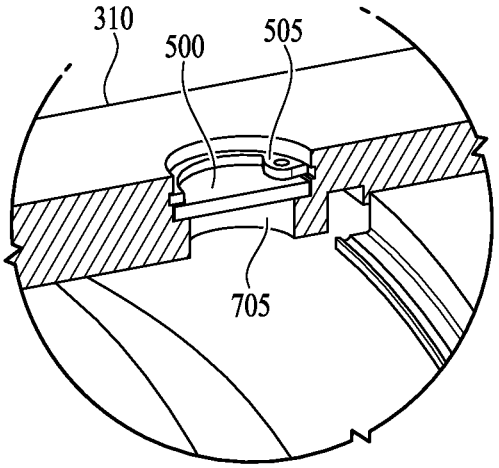
FIG. 7A is an enlarged perspective view of the porous disk of FIG. 7 of an illustrative embodiment.

Turning to FIG. 7 and FIG. 7A, one or more porous disks 500 may be inserted into holes 705 near top 700 of bellows section 300 and/or the top of bellows 350. Porous disks 500 may be held in place with snap rings and/or retaining rings 505. Porous disks 500 may be made of sintered stainless steel and allow air to escape as soon as bellows 350 makes contact with well fluid. The amount and/or rate of air flow escaping from bellows 350 may be controlled, for example by employing disks 500 having various porosity.

Figure 8A:
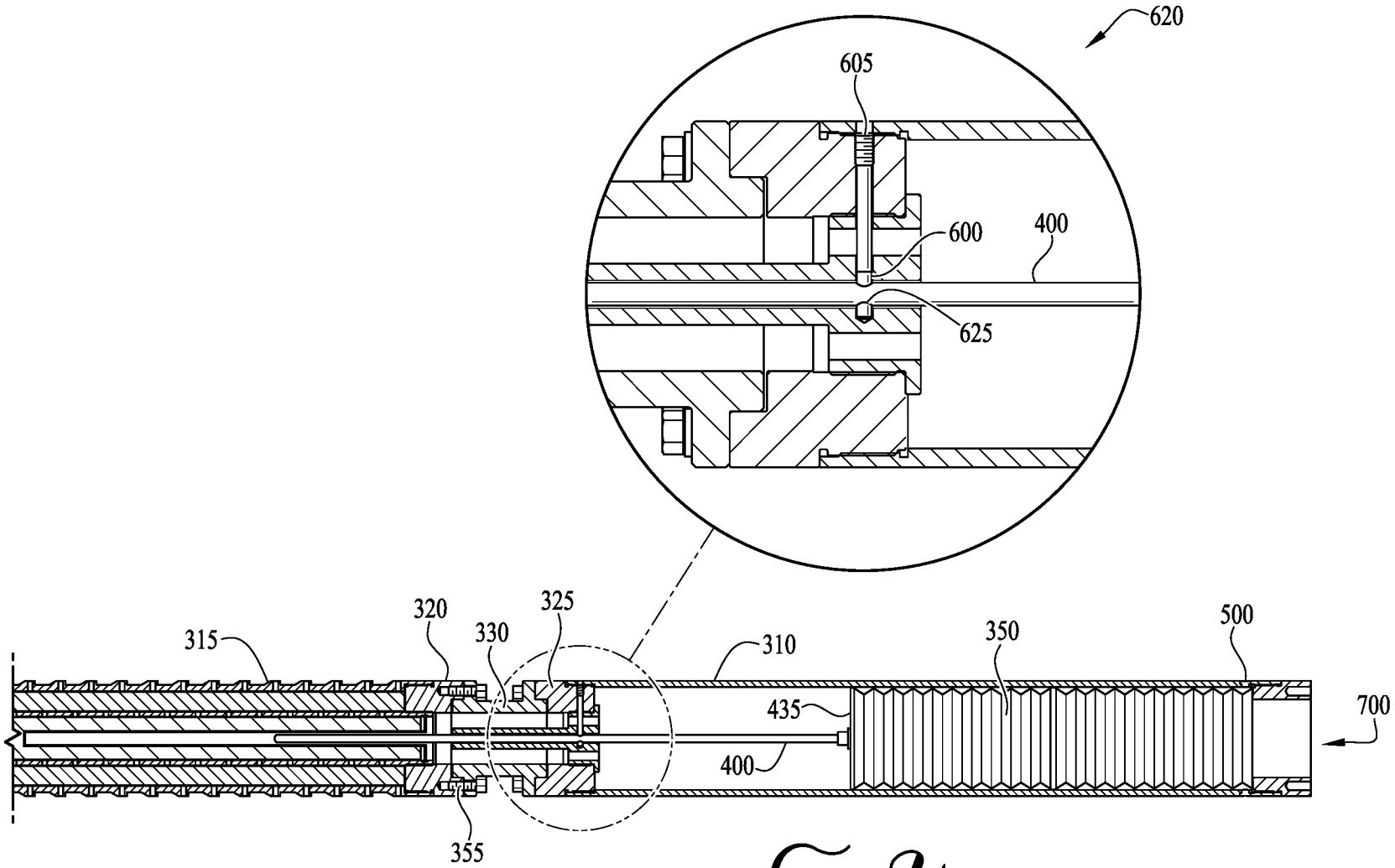
FIG. 8A is a cross sectional view of a bellows held stationary by an anti-movement system of an illustrative embodiment.
Figure 8B:
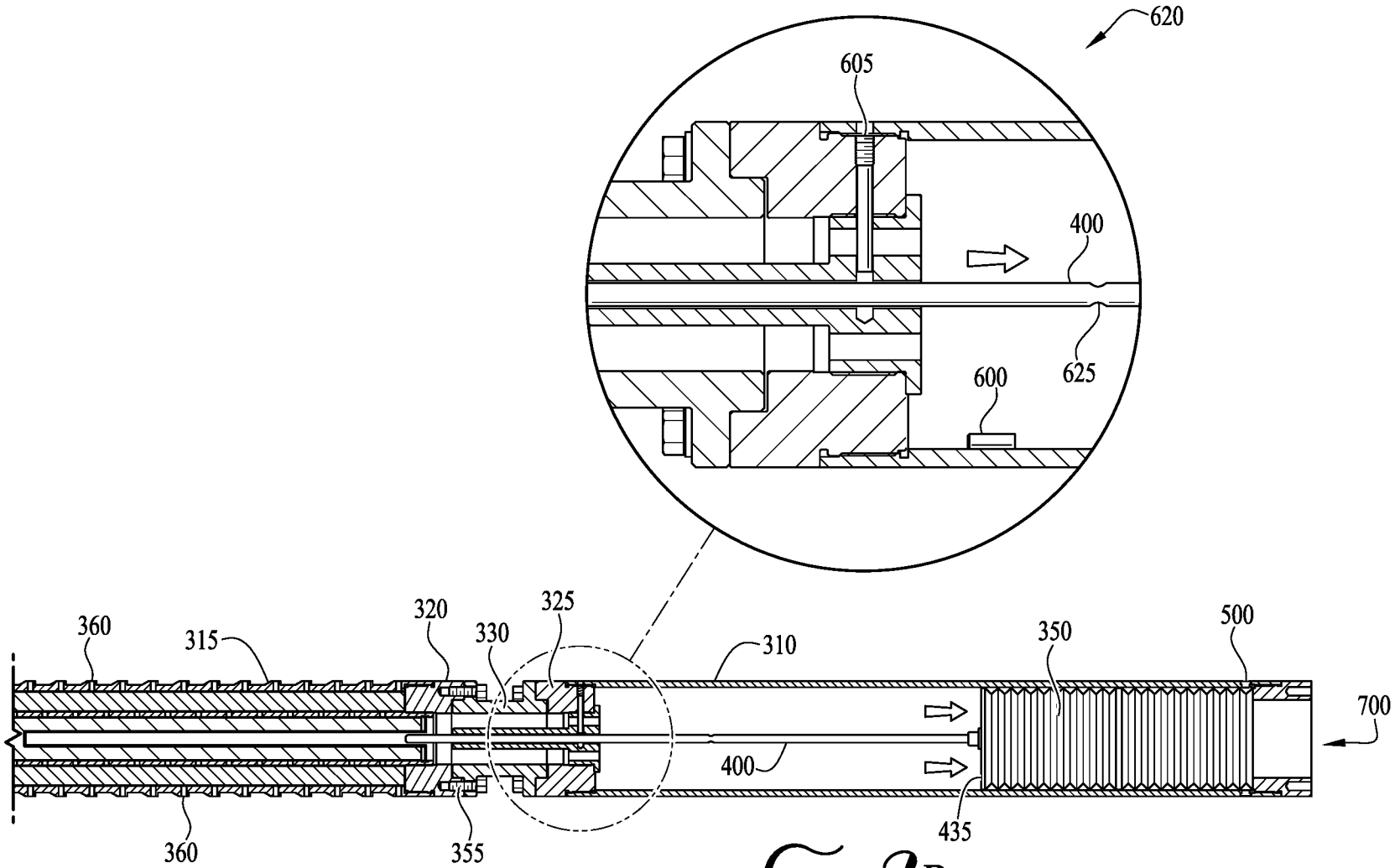
FIG. 8B is a cross sectional view of a bellows of an illustrative embodiment in a retracted position.
Figure 8C:
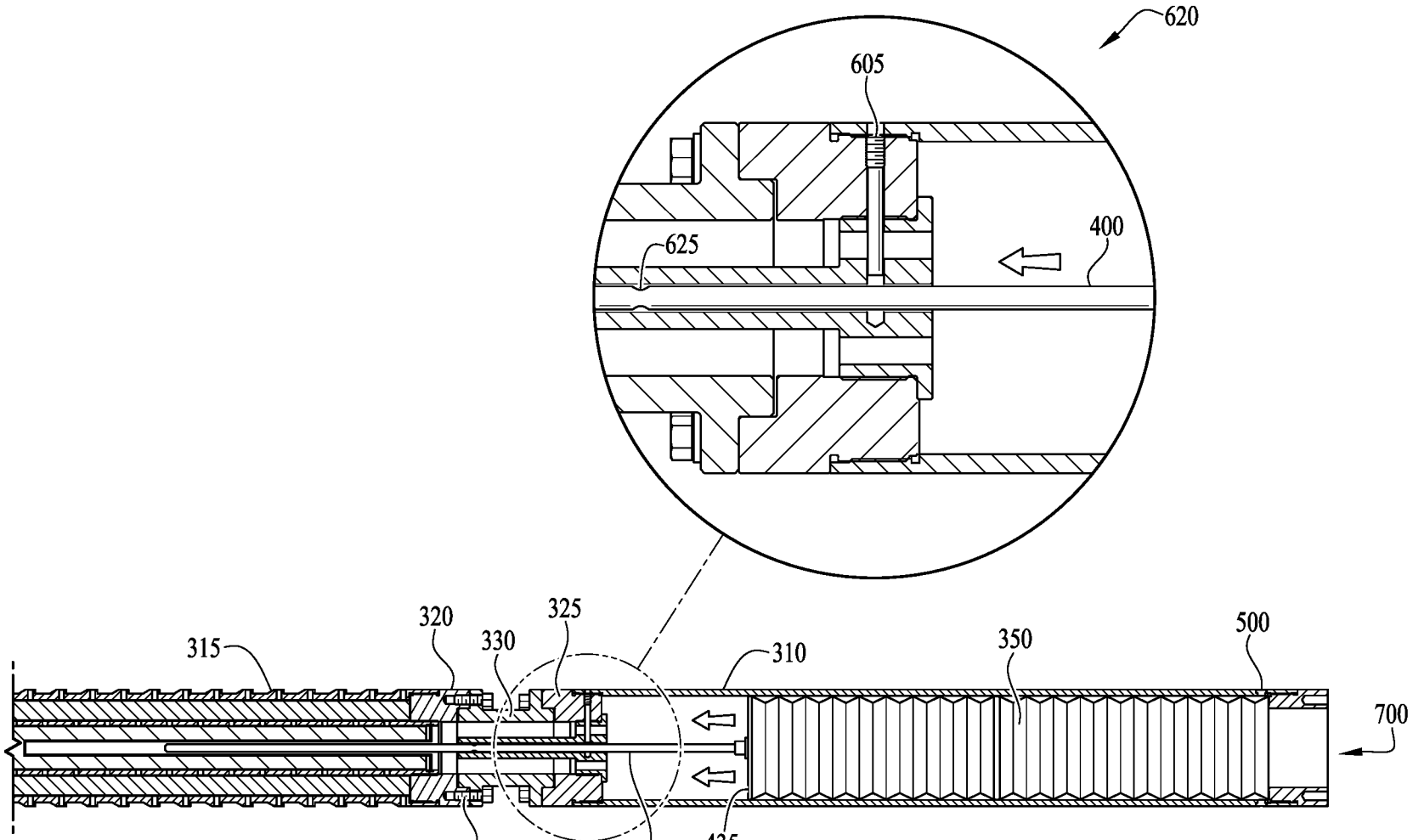
FIG. 8C is a cross sectional view of a bellows of an illustrative embodiment in an expanded position.

FIG. 8A-8C illustrates a bellows anti-movement system of an illustrative embodiment. In FIG. 8A, pin 600 is intact and bellows 350 is restrained from concertinaed motion. FIG. 8A illustrates the positioning of anti-movement system 620 and bellows 350 during filling of motor 125 with motor oil and/or during deployment and positioning of ESP assembly 100 within well 110. As shown in FIG. 8A, anti-movement system 620 and/or pin 600 may be positioned to hold bellows 350 in a neutral position that is mid-way between extended and retracted and/or partially extended or partially retracted. Anti-movement system 620 may be in the position of FIG. 8A during filling of motor 125 with motor oil and/or during positioning of assembly 100 within well 110, for example. In FIG. 8B, pin 600 has melted and/or sheared, and bellows 350 has retracted in response to motor oil retraction, for example when motor 125 is turned off. During retraction, well fluid may enter flow holes 360, pass through filter section 305 where debris may be removed, and flow into bellows section 300 below bellows tail 435. In FIG. 8C, pin 600 has melted and bellows 350 has extended, for example when motor 125 is turned on and operating within well 110 and/or when steam is injected into the well. During extension of bellows 350, well fluid may be expelled from flow holes 360 as motor oil expands and bellows tail 435 extends downwards and/or towards filter section 305.

A bellows motor expansion chamber for electric submersible pumps has been described. Illustrative embodiments may provide a bellows motor protector that may be free from premature compression or extension, such as during placement of the pump assembly in a well or initial filling of the motor with motor oil. Illustrative embodiments may prevent premature displacement of motor oil from inside the motor. Illustrative embodiments may provide a single piece bellows that equalizes pressure within an ESP motor and reduces cost.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

The invention claimed is:

1. An electric submersible pump (ESP) assembly comprising:

an electric submersible motor between a thrust chamber and a motor expansion chamber, the motor expansion chamber comprising:

a bellows coupled to a releasable bellows anti-movement system, the releasable bellows anti-movement system comprising a heat-activated release and alterable between:

an immobilizing position, wherein the releasable anti-movement system prevents concertinaed movement of the bellows in the immobilizing position, and a released position, wherein the bellows is concertinaedly moveable in the released position; and wherein the releasable bellows anti-movement system is in the immobilizing position below a release temperature and in the released position above the release temperature.

2. The ESP assembly of claim 1, wherein the heat-activated release comprises a pin configured to one of melt, shear or a combination thereof at the release temperature.

3. The ESP assembly of claim 1, wherein the bellows comprises a stem extending longitudinally from an end of the bellows, the heat-activated release comprises a meltable pin, and the meltable pin extends through the stem, wherein the motor expansion chamber further comprises a filter section, and the stem extends within a filter of the filter section at least when the bellows is extended, and wherein the meltable pin melts at between 180° C. and 190° C.

4. The ESP assembly of claim 1, wherein the motor expansion chamber further comprises a filter section, the filter section comprising a first filter around a second filter.

5. The ESP assembly of claim 4, wherein the filter section comprises:

a plurality of protruding ribs extending around a housing of the filter section; and a series of flow holes extending through the housing and fluidly coupling the first filter with well fluid, wherein the protruding ribs comprise a bottom side angled upward towards the electric submersible motor, and wherein each flow hole of the series of flow holes extends through a protruding rib of the plurality of protruding ribs.

6. The ESP assembly of claim 4, wherein the filter section comprises a bullet shaped end portion.

7. The ESP assembly of claim 1, wherein the electric submersible motor is configured to be operated downhole, the releasable bellows anti-movement system is initially in the immobilizing position, and the heat-activated release is configured to alter the bellows anti-movement system into the released position after placement of the electric submersible motor downhole.

8. The ESP assembly of claim 1, wherein the motor expansion chamber comprises a porous disk inserted into an aperture extending through a housing of the motor expansion chamber, and wherein the thrust chamber comprises a plurality of mechanical seals, a plurality of check valves, and at least one thrust bearing.

9. A method of equalizing pressure of an electric submersible pump (ESP) motor comprising:

assembling an ESP system with the ESP motor between a thrust chamber and a bellows seal section;

securing a bellows of the bellows seal section from concertinaed motion with an anti-movement pin; and configuring the anti-movement pin to release at a selected temperature.

10. The method of claim 9, wherein the selected temperature is selected such that the anti-movement pin remains secure until the ESP system is set within a downhole well and releases one of prior to operation of the ESP system or at initial operation of the ESP system, wherein the bellows, when released, equalizes pressure of the ESP motor by expanding as motor oil expands and contracting when the ESP motor is turned off, and wherein the anti-movement pin releases by one of melting, shearing, or a combination thereof.

11. The method of claim 9, further comprising providing positive internal pressure in the thrust chamber using a plurality of check valves in the thrust chamber.

12. The method of claim 9, further comprising assembling a filter at a well fluid inlet of the bellows of the bellows seal section to prevent debris from plugging convolutions of the bellows.

13. The method of claim 12, wherein the filter comprises at least two concentric layers of steel wool separated by an apertured pipe.

14. The method of claim 12, wherein the filter comprises a ribbed housing with flow holes extending through ribs of the ribbed housing, and the method further comprising angling the ribs to produce low pressure area over the flow holes and prevent clogging of the flow holes, and wherein the method comprises interposing the filter between the bellows and a location of well fluid entry into the bellows seal section to slow the speed of entry of well fluid into the bellows seal section.

15. The method of claim 9, wherein the anti-movement pin is a retaining pin comprised of a eutectic material, and the anti-movement pin is configured to release at the selected temperature by forming the retaining pin of the eutectic material that melts at the selected temperature.

16. The method of claim 9, further comprising lowering the ESP system into a steam-assisted gravity drainage (SAGD) well with the anti-movement pin secured in place during lowering.

17. An electric submersible pump (ESP) assembly comprising:

a bellows motor expansion chamber comprising a metal bellows, the motor expansion chamber comprising:

the metal bellows coupled to a releasable bellows anti-movement system, the releasable bellows anti-movement system comprising a heat-activated release and alterable between:

an immobilizing position, wherein the releasable anti-movement system prevents concertinaed movement of the metal bellows in the immobilizing position, and a released position, wherein the metal bellows is concertinaedly moveable in the released position, wherein the releasable bellows anti-movement system is in the immobilizing position below a release temperature and in the released position above the release temperature; and a well fluid inlet of the bellows motor expansion chamber comprising a filter section, the filter section comprising:

at least two concentric filters, each filter of the at least two concentric filters of varying porosity; and housing surrounding the at least two concentric filters, the housing comprising angled ribs and flow holes serving as the well fluid inlet of the filter section, the flow holes extending through the housing and the at least two concentric filters.

18. The ESP assembly of claim 17, wherein the housing further comprises a bullet shaped nose.

19. The ESP assembly of claim 17, wherein the flow holes extend through the angled ribs of the housing.

20. The ESP assembly of claim 17, wherein the angled ribs comprise an upstream side angled upwards towards an electric submersible motor coupled above the bellows motor expansion chamber, and wherein the at least two concentric filters comprise stainless steel wool secured within an apertured tube between a pair of filtration disks.

* * * * *